US006430758B1

(12) United States Patent
Cabrera

(10) Patent No.: US 6,430,758 B1
(45) Date of Patent: Aug. 13, 2002

(54) PORTABLE TRAINING TOILET

(76) Inventor: Byron Cabrera, 5965 Flora Ave. #D, Huntington Park, CA (US) 90255

( * ) Notice: Subject to any disclaimer, the term of this patent is extended or adjusted under 35 U.S.C. 154(b) by 0 days.

(21) Appl. No.: 10/028,538

(22) Filed: Oct. 25, 2001

(51) Int. Cl.[7] ..... A47K 11/06
(52) U.S. Cl. ..... 4/484; 4/353; 4/661; 4/902
(58) Field of Search ..... 4/484, 483, 902, 4/363, 364, 365, 353, 661; 434/258; D13/313

(56) References Cited

U.S. PATENT DOCUMENTS 1,710,036 A * 4/1929 Tilden ..... 4/353
1,835,540 A * 12/1931 Tilden ..... 4/353
D99,439 S * 4/1936 Lauber ..... D23/313
2,500,463 A * 3/1950 Locke ..... 4/353
4,069,522 A * 1/1978 Messmer et al. ..... 4/483
4,371,992 A * 2/1983 Rivera ..... 4/353
4,553,275 A * 11/1985 Goldstein ..... 4/661
4,932,084 A * 6/1990 Hanson ..... 4/353
5,509,808 A * 4/1996 Bell
5,690,495 A * 11/1997 Collier ..... 434/258
5,920,918 A * 7/1999 Thomas ..... 4/353
6,038,711 A * 3/2000 Clarke ..... 4/902

* cited by examiner

*Primary Examiner*—Charles R. Eloshway
*Assistant Examiner*—Khoa Huynh
(74) *Attorney, Agent, or Firm*—Goldstein & Lavas, P.C.

(57) ABSTRACT

A portable training toilet including a toilet portion having an open upper end and a closed lower end. The open upper end has a seat portion hingedly coupled thereto. The seat portion has a cover portion hingedly disposed thereover. A tank portion is secured to and extends upwardly from the toilet portion. The tank portion has an open upper end and a closed lower end. The open upper end has a cover member hingedly coupled thereto. The tank portion has a horizontal slot therethrough in a front wall thereof.

1 Claim, 2 Drawing Sheets

PORTABLE TRAINING TOILET

BACKGROUND OF THE INVENTION

The present invention relates to a portable training toilet and more particularly pertains to providing a place for a young child to relieve themselves that will allow for easy waste disposal.

The use of toilet-training devices is known in the prior art. More specifically, toilet-training devices heretofore devised and utilized for the purpose of facilitating the potty training of children are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,069,522 to Messmer discloses a baby commode with an opening forming a pocket in the backrest for holding various accessory devices. U.S. Pat. No. 5,509,808 to Bell discloses a toy toilet training device comprised of a commode with means for storing accessories. U.S. Pat. No. 5,251,352 to Sansom discloses a plastic portable toilet with a tank incorporated.

While these devices fulfill their respective, particular objective and requirements, the aforementioned patents do not describe a portable training toilet for providing a place for a young child to relieve themselves that will allow for easy waste disposal.

In this respect, the portable training toilet according to the present invention substantially departs from the conventional concepts and designs of the prior art, and in doing so provides an apparatus primarily developed for the purpose of providing a place for a young child to relieve themselves that will allow for easy waste disposal.

Therefore, it can be appreciated that there exists a continuing need for a new and improved portable training toilet which can be used for providing a place for a young child to relieve themselves that will allow for easy waste disposal. In this regard, the present invention substantially fulfills this need.

SUMMARY OF THE INVENTION

In the view of the foregoing disadvantages inherent in the known types of toilet-training devices now present in the prior art, the present invention provides an improved portable training toilet. As such, the general purpose of the present invention, which will be described subsequently in greater detail, is to provide a new and improved portable training toilet which has all the advantages of the prior art and none of the disadvantages.

To attain this, the present invention essentially comprises a toilet portion having an open upper end and a closed lower end. The open upper end has a seat portion hingedly coupled thereto. The seat portion has a cover portion hingedly disposed thereover. A tank portion is secured to and extends upwardly from the toilet portion. The tank portion has an open upper end and a closed lower end. The open upper end has a cover member hingedly coupled thereto. The cover member has a toilet paper roll holder secured thereto. The tank portion has a horizontal slot therethrough in a front wall thereof. A quantity of plastic bags are disposed within the tank portion. The plastic bags are extended outwardly of the horizontal slot for being individually removed from the tank portion and positioned within the open upper end of the toilet portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable training toilet which has all the advantages of the prior art toilet-training devices and none of the disadvantages.

It is another object of the present invention to provide a new and improved portable training toilet which may be easily and efficiently manufactured and marketed.

It is a further object of the present invention to provide a new and improved portable training toilet which is of durable and reliable construction.

An even further object of the present invention is to provide a new and improved portable training toilet which is susceptible of a low cost of manufacture with regard to both materials and labor, and which accordingly is then susceptible of low prices of sale to the consuming public, thereby making such a portable training toilet economically available to the buying public.

Even still another object of the present invention is to provide a new and improved portable training toilet for providing a place for a young child to relieve themselves that will allow for easy waste disposal.

Lastly, it is an object of the present invention to provide a new and improved portable training toilet including a toilet portion having an open upper end and a closed lower end. The open upper end has a seat portion hingedly coupled thereto. The seat portion has a cover portion hingedly disposed thereover. A tank portion is secured to and extends upwardly from the toilet portion. The tank portion has an open upper end and a closed lower end. The open upper end has a cover member hingedly coupled thereto. The tank portion has a horizontal slot therethrough in a front wall thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
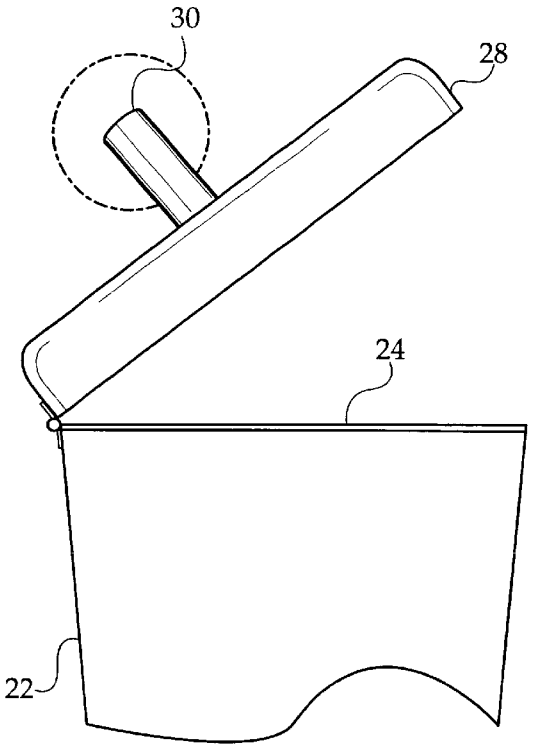
FIG. 2 is a side sectional view of the present invention illustrating the cover member of the tank portion thereof.
Figure 1:
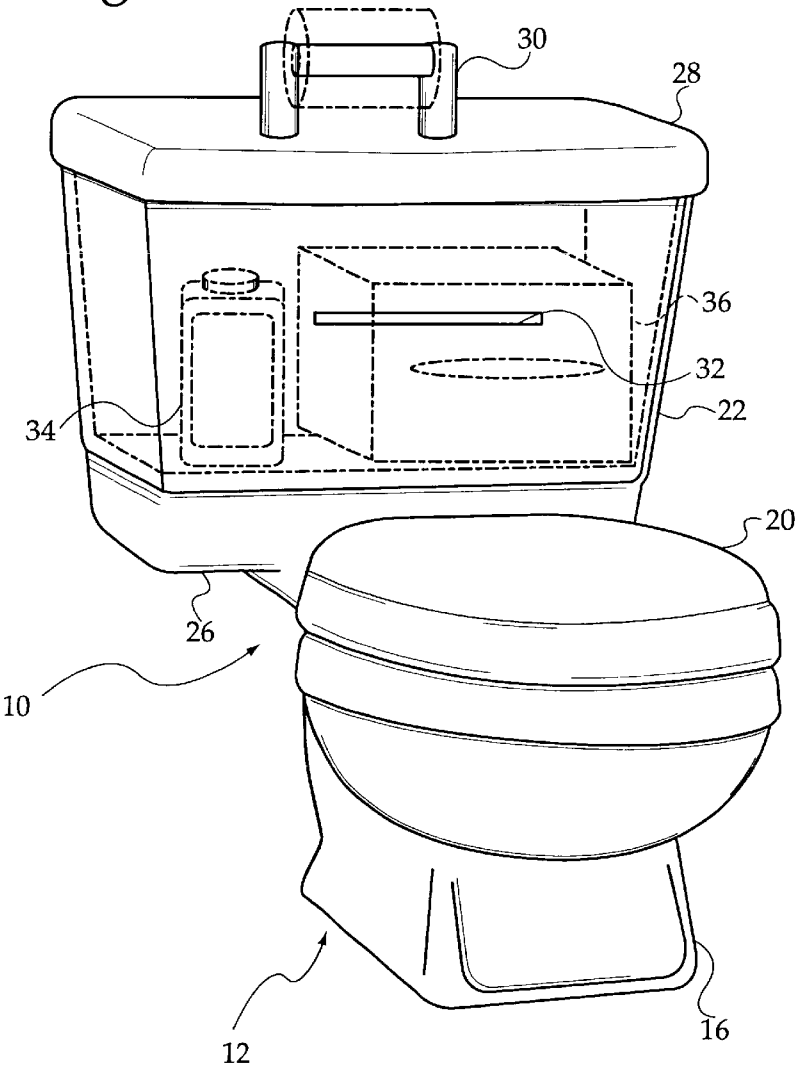
FIG. 1 is a perspective view of the preferred embodiment of the portable training toilet constructed in accordance with the principles of the present invention.
Figure 3:
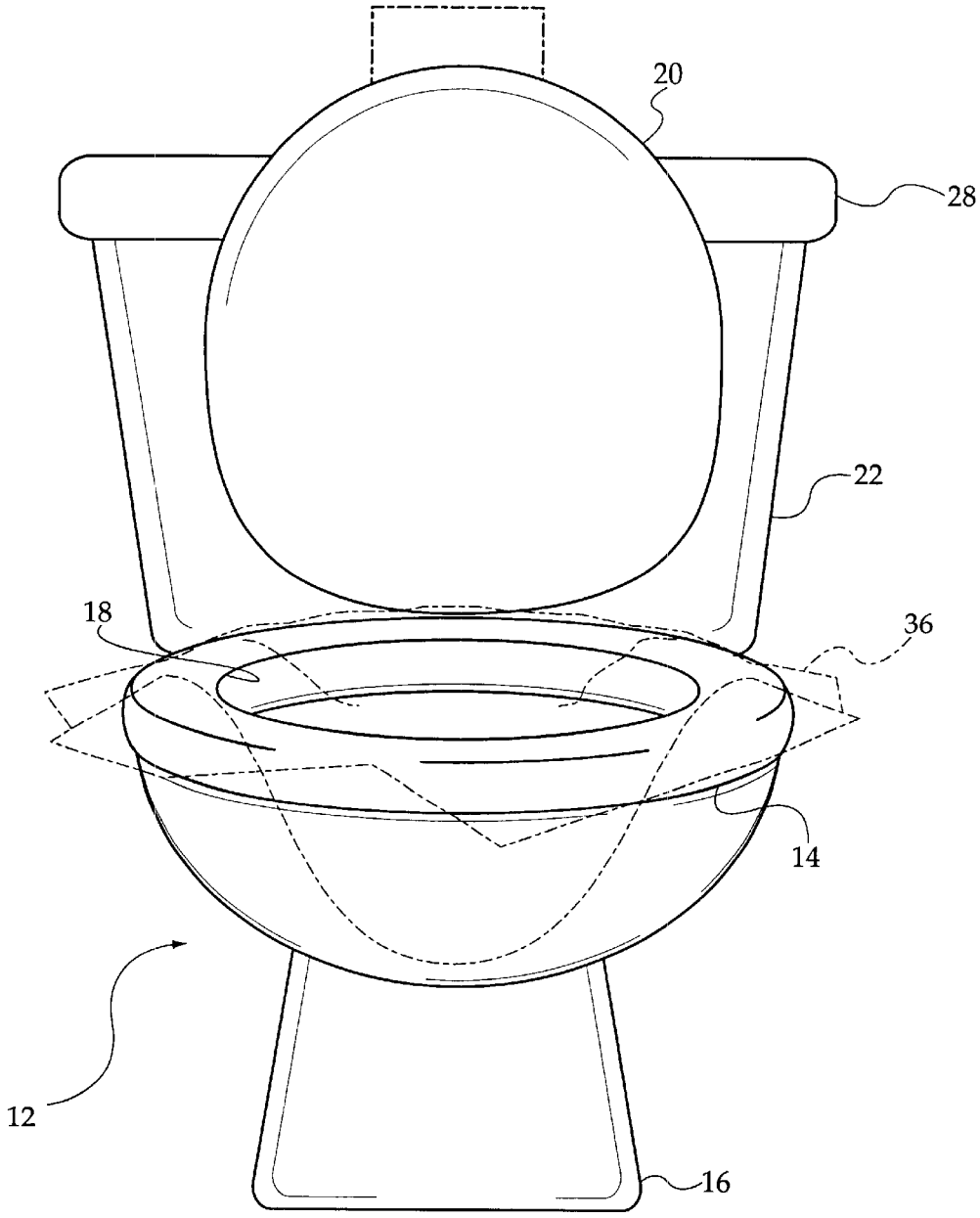
FIG. 3 is an elevated front view of the present invention.

With reference now to the drawings, and in particular, to FIGS. 1 through 3 thereof, the preferred embodiment of the new and improved portable training toilet embodying the principles and concepts of the present invention and generally designated by the reference number 10 will be described.

Specifically, it will be noted in the various figures that the device relates to a portable training toilet for providing a place for a young child to relieve themselves that will allow for easy waste disposal. In its broadest context, the device consists of a toilet portion, a tank portion, and a quantity of plastic bags. Such components are individually configured and correlated with respect to each other so as to attain the desired objective.

The toilet portion 12 has an open upper end 14 and a closed lower end 16. The closed lower end 16 is tapered outwardly to provide a stable base when the toilet portion 12 is positioned on a recipient surface. The open upper end 14 has a seat portion 18 hingedly coupled thereto. The seat portion 18 has a cover portion 20 hingedly disposed thereover.

The tank portion 22 is secured to and extends upwardly from the toilet portion 12. The tank portion 22 has an open upper end 24 and a closed lower end 26. The open upper end 24 has a cover member 28 hingedly coupled thereto. The cover member 28 has a toilet paper roll holder 30 secured thereto. The tank portion 22 has a horizontal slot 32 therethrough in a front wall thereof. The tank portion 22 will provide an additional storage space for various accessory items, such as baby powder 34 and the like. Note FIG. 1.

The quantity of plastic bags 36 are disposed within the tank portion 22. The plastic bags 36 are extended outwardly of the horizontal slot 32 for being individually removed from the tank portion 22 and positioned within the open upper end 14 of the toilet portion 12.

In use, an individual plastic bag 36 is pulled out of the tank portion 22 through the horizontal slot 32 and positioned within the open upper end 14 of the toilet portion 12. The seat portion 18 is then lowered over the open upper end 14 to hold the plastic bag 36 is place. The child can then sit on the seat portion 18 to relieve themselves. Once finished, the plastic bag 36 can be removed, holding any fecal and/or urinary waste from the child for easy disposal whereby the toilet portion 12 remains essentially sanitary.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable training toilet for providing a place for a young child to relieve themselves that will allow for easy waste disposal comprising, in combination:

a toilet portion having an open upper end and a closed lower end, the open upper end having a seat portion hingedly coupled thereto, the seat portion having a cover portion hingedly disposed thereover;

a tank portion secured to and extending upwardly from the toilet portion, the tank portion having an open upper end and a closed lower end, the open upper end having a cover member hingedly coupled thereto, the cover member having a toilet paper roll holder secured thereto, the tank portion having a horizontal slot therethrough in a front wall thereof; and a quantity of plastic bags disposed within the tank portion, the plastic bags being extended outwardly of the horizontal slot for being individually removed from the tank portion and positioned within the open upper end of the toilet portion.

* * * * *